United States Patent [19]

Naito

[11] Patent Number: 4,886,263

[45] Date of Patent: Dec. 12, 1989

[54] METHOD FOR SORTING PAPERBOARD BLANKS

[76] Inventor: Minoru Naito, 11-9, 6-chome, Takamoridai Kasugai-shi, Aichi, Japan

[21] Appl. No.: 144,194

[22] Filed: Jan. 15, 1988

[30] Foreign Application Priority Data

Jan. 21, 1987 [JP] Japan ..... 62-13137

[51] Int. Cl.[4] ..... B65H 29/66

[52] U.S. Cl. ..... 271/176; 271/183; 271/202

[58] Field of Search ..... 271/202, 203, 270, 151, 271/176, 183

[56] References Cited

U.S. PATENT DOCUMENTS 4,313,600 2/1982 Mosburger ..... 271/203

4,598,901 7/1986 Thomas ..... 271/202

4,750,732 6/1988 Hara ..... 271/202 X

*Primary Examiner*—Richard A. Schacher

[57] ABSTRACT

A method for sorting paperboard blanks into groups of identical length blanks. When an order chanber is effected, the succeeding blanks formed in accordance with the new order are accumulated upon the preceding blanks in an orderly manner by intermittently driving a first conveyor so that the reduction ratio or speed differential becomes relatively small when a blank formed in accordance with the new order arrives at the first conveyor. In an alternate method, the succeeding blanks are positively disposed upon the preceding blanks fed to a first conveyor having a vacuum suction area defined therein by moving each preceding blank a desired distance, so that the vacuum suction area may be exposed behing the preceding blanks.

3 Claims, 6 Drawing Sheets

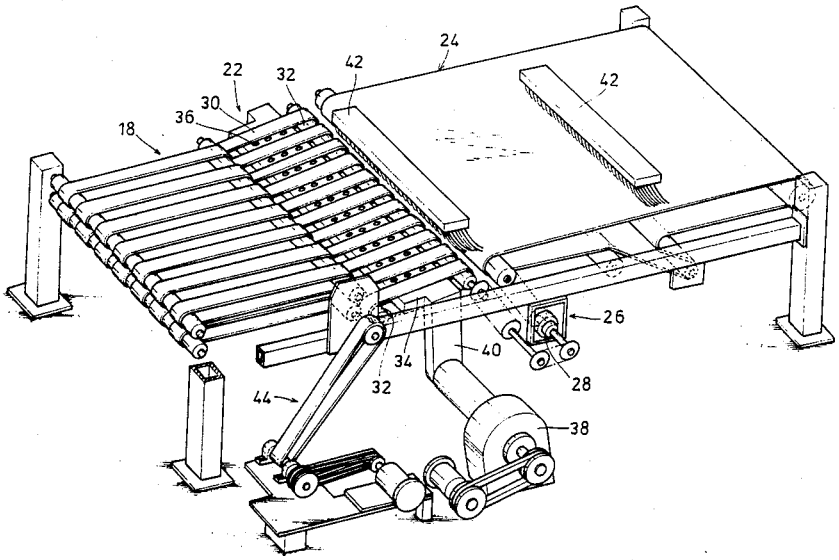

METHOD FOR SORTING PAPERBOARD BLANKS

BACKGROUND OF THE INVENTION

1. Field of the Invention

The present invention relates to a method for sorting paperboard blanks wherein a continuous paperboard web is cut into individual blanks of a predetermined length. More particularly, it relates to such a method for sorting paperboard blanks into individual blank groups in an orderly manner when a cut length change is effected, so that the blanks formed after the size change do not interfere with blanks formed before the size change. The present invention is especially concerned with a novel technical means capable of controlling the conveyor speed so that the second and subsequent blanks formed after the size change may accumulate upon the previous blanks in an orderly shingling manner.

2. Description of the Prior Art

In a corrugator line for continuously producing a web of corrugated paperboard, the output web of corrugated paperboard is cut into individual blanks of a predetermined length by means of rotary cutters generally during the final production step. The individual blanks are then fed into various types of processing machines such as, for example slotters and creasers. At this time, the individual blanks of a predetermined length are supplied to a downstream stacker where the blanks are accumulated until a predetermined number of blanks is in fact accumulated. To this end, the multiplicity of blanks cut by means of the cutters are sorted into a group of blanks of a desired length and are intermittently fed upon a well-known conveyor. A representative conveyor is disclosed in FIG. 1 of Japanese Laid-Open Patent Publication No. 52-129161 and as shown therein, each of the preceding blanks of a predetermined length located upon a belt conveyor is partially overlapped by the succeeding blank of an identical size (this condition is called "shingling"). A mass of the blanks thus formed is fed by means of the conveyor in a "shingling" condition.

When a continuous paperboard web is cut into blanks, the cut length has to be frequently changed in order to suit the various requirements specified by customers. Thus, when the change in cut length (hereinafter referred to as the "order change") is achieved, the rotational speed of the rotary cutters in the corrugator line is changed, so that individual blanks of a desired length may be cut thereafter.

As should be apparent, when an order change is made, blank groups comprising blanks having a different cut length in accordance with a new length order are fed following the blank groups comprising blanks having a cut length in accordance with the old length order. It is, therefore, necessary to positively isolate and sort the two different groups of blanks, one for the old order and the other for the new order, so that during transportation upon the conveyor, the leading end of the first blank for the new order does not interfere with the trailing end of the last blank for the old order.

Various methods have been heretofore proposed in order to sort paperboard blanks being conveyed upon a conveyor. Basically, three kinds of blank sorting methods have been heretofore proposed depending upon the various arrangements of the conveyor. For instance, the first method is disclosed within Japanese Laid-Open Patent Publication No. 60-258055 filed by the same assignee as the present invention. As shown in FIG. 1, the sorting apparatus for carrying out the first method includes sandwich conveyors 16,18 and first and second conveyors 22,24 arranged in series downstream of cutters 10 arranged within the vicinity of the final production step of a corrugated blank production line. The first conveyor 22 includes a vacuum box 34 mounted for an underside thereof, which vacuum box applies a vacuum suction force to blanks 14 conveyed onto the conveyor 22. As noted hereinabove, the blank groups 14 cut from a continuous paperboard web 12 include two different length blanks, one having a first desired length formed in accordance with an old order and the other having a second desired length formed in accordance with a new order. Since this distinction is important in describing the present invention, the blank formed in accordance with the old order will be designated by the symbol "OS"; and the blank formed in accordance with the new order will be designated by the symbol "NS".

When an order change is effected, the last sheet OSn of the blanks OS cut before the size change, which has been cut by means of the cutters 10 and fed onto the sandwich conveyors 16,18, is sensed by means of a suitable sensor when it has arrived at the first conveyor 22. Thereupon, as shown in FIG. 2(*a*), the first and second conveyors 22,24, which have been driven at a regular speed Vc, are simultaneously accelerated to a speed Vr which is faster than the regular speed Vc(Vc−Vr), thereby transferring downstream, at a relatively high rate of speed, the blank groups OS which were formed before the effected size change. When all the blanks OS have been transferred to the second conveyor 24, as shown in FIG. 2(*c*), the sensor detects this state so as to stop the first conveyor 22 (Vr→Vo), so that the blanks NS formed after the size change may be accumulated upon the first conveyor 22 in a shingled condition. As soon as this occurs, the first and second conveyors 22,24 are returned to the regular speed Vc (Vo→Vr and Vr→Vc, respectively).

According to this method, when the first blank NS-1 formed after the size change arrives at the first conveyor 22, vacuum suction force produced within the conveyor 22 will effectively act upon the blank NS-1 so that the latter may be properly held in place upon the conveyor 22, as shown in FIG. 2(*c*). However, since the previous blank NS-1 covers the vacuum suction area of the conveyor 22, the vacuum suction force will not effectively act upon the second and subsequent blanks NS-2, NS-3 . . . , as shown in FIG. 2(*d*).

Normally, the operating speed Vb of the sandwich conveyor 18 is 20% faster than the maximum production speed Vdf max of the corrugated blank production line. Practically, the fastest machine operates at 300 m/min. Thus, the second and subsequent blanks NS-2 . . . are fed by means of the sandwich conveyor 18 at a high rate of speed Vb and are discharged to the first conveyor 22, and at the moment of discharge, the blanks NS-2 . . . have considerable inertia resulting from the high rate of speed Vb. In addition, as explained above, the vacuum suction force is not acting upon the second and subsequent blanks NS-2 . . . ; they are only subjected to pressure exerted by means of brushes (which will be described later), or they are frictionally braked as they engaged the surface of the preceding blank NS upon the first conveyor 22.

For this reason, the second and subsequent blanks NS-2 . . . discharged at the speed Vb tend to slide upon the previous blank NS and overrun the same in the forward direction, or move sideways due to uneven frictional resistance. In an extreme case, the forward end of the succeeding blank may strike against the rear end of the preceding blank (this condition is called "billiards phenomenon") causing undesired problems to the blanks, such as folds and bends. All of these causes have led to unusual conditions wherein the blanks are not fed upon the conveyor in an orderly shingled manner.

The second method is disclosed within Japanese Laid-Open Patent Publication No. 52-129161 and as shown therein, the apparatus for performing the method includes a liftable stopper for stopping blanks which is disposed between belts of a conveyor. The stopper may be lifted at predetermined times so as to thereby forcibly stop the blank specified in accordance with a new order, the succeeding blanks being accumulated upon the stopped blank. Here again, the second method entails the same problem as the first method.

The third method is to provide a variable speed motor as the power source for the first conveyor which is entirely separate from the power source for the second conveyor. When blanks formed after the size change are arriving at the first conveyor, the first conveyor is operated at a lower speed than the speed Vc during normal operation. This method, however, requires an expensive, variable speed motor. Also, the speed ratio of the motor relative to the sandwich conveyor tends to become large, causing the overlapping condition to deteriorate with time.

OBJECTS OF THE INVENTION

It is, accordingly, an object of the present invention to eliminate the noted disadvantages of the prior art methods for sorting paperboard blanks.

It is another object of the present invention to provide a novel method for sorting paperboard blanks wherein a series of paperboard blanks are accumulated upon a conveyor in an orderly shingled manner by minimizing the reduction ratio during discharge of the second and subsequent blanks, formed in accordance with a new order, to a conveyor, and/or in a conveyor having a vacuum suction area, by securing the vacuum suction area behind the preceding blank.

SUMMARY OF THE INVENTION

The objects of the present invention are attained by means of a method for sorting paperboard blanks of a first length specified by means of a first order from paperboard blanks of a second length specified by means of a second order wherein a continuous paperboard web is cut into individual blanks of an identical length, and the output blanks are fed by means of first and second conveyors in a partially overlapped condition, and wherein the method comprises the steps of sensing the arrival of the last sheet of the blanks specified in accordance with the first order at the first conveyor; simultaneously accelerating the first and second conveyors; sensing the transfer of all the blanks specified in accordance with the first order to the second conveyor; momentarily stopping the first conveyor; sensing the arrival of a first sheet of the blanks specified in accordance with the second order at the first conveyor which is in its stopped condition, and driving the first conveyor for a predetermined time.

In an alternative form of the invention, a method is provided for sorting paperboard blanks of a first length, as specified by means of a first order, from paperboard blanks of a second length specified by means of a second order, wherein a continuous paperboard web is cut into individual blanks of an identical length in accordance with a particularly specified order, and the output blanks are fed in partially overlapped condition by means of a first conveyor having a vacuum suction area and by means of a second conveyor, which comprises the steps of sensing the arrival of the last sheet of the blanks specified in accordance with the first order at the first conveyor; simultaneously accelerating the first and second conveyors; sensing the transfer of all the blanks specified in accordance with the first order to the second conveyor; momentarily stopping the first conveyor; sensing the arrival of the first sheet of the blanks specified in accordance with the second order to the first conveyor which is in its stopped condition; and driving the first conveyor for a predetermined time, thereby moving the preceding blank specified in accordance with the second order a predetermined distance downstream so that a vacuum suction area which is secured upon the first conveyor is not covered by the preceding blank.

Thus, according to the present invention, the succeeding blanks formed in accordance with the new order may be positively positioned upon the preceding blanks in the following way: (1) the first conveyor is intermittently driven so that the reduction ratio becomes relatively small when the blank formed in accordance with the new order arrives at the first conveyor; or (2) in connection with the conveyor having the vacuum suction area, the preceding blank supplied to the first conveyor is moved a desired distance, so that the vacuum area may be exposed behind the preceding blank. Furthermore, in a corrugation board production line operated at a high rate of speed, the above two operations may be used jointly to increase the intended effects of the invention.

BRIEF DESCRIPTION OF THE DRAWINGS

The present invention will become more fully apparent from the claims and description as it proceeds in connection with the drawings, wherein

DETAILED DESCRIPTION OF THE INVENTION

Figure 3:
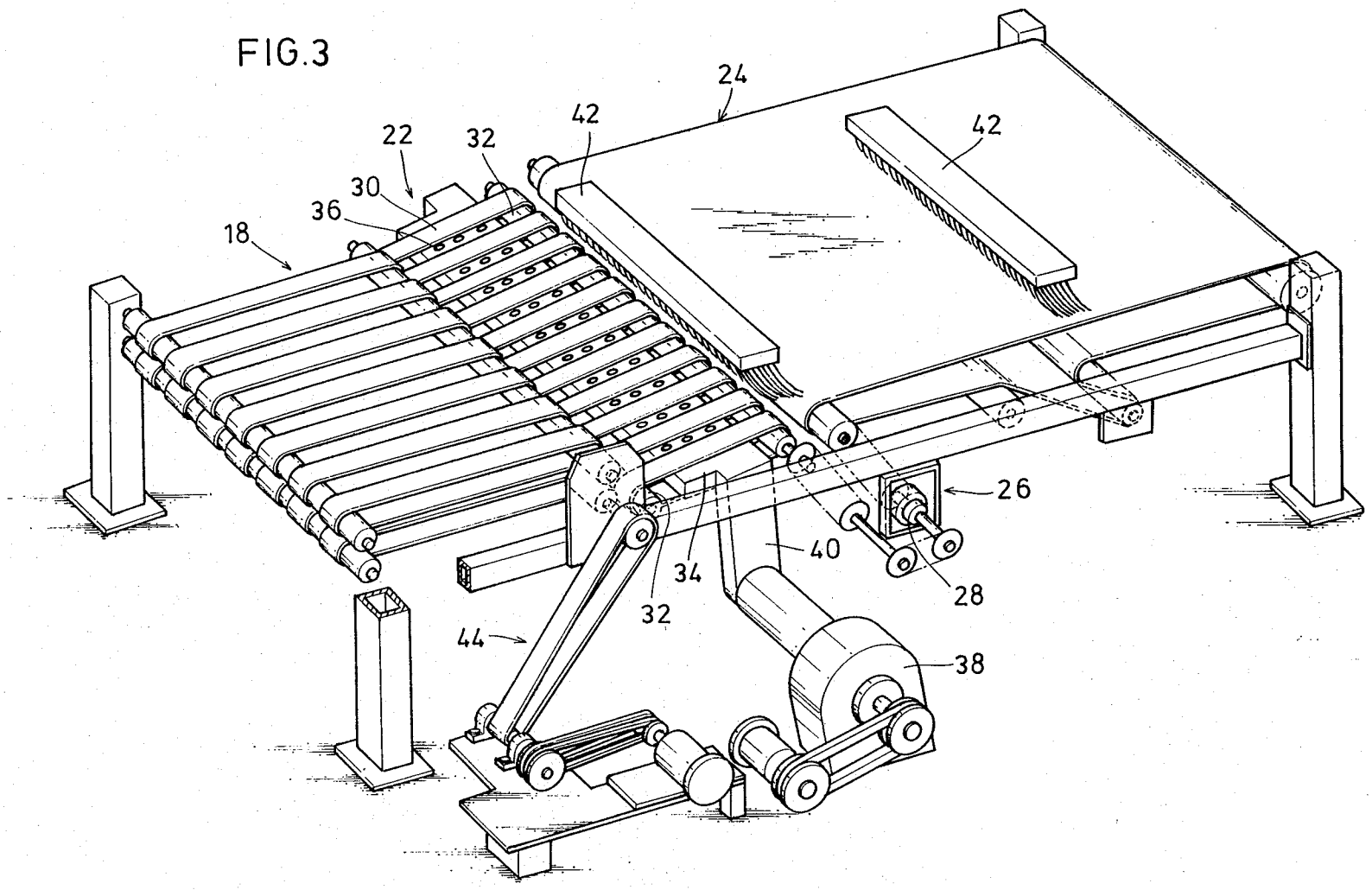
FIG. 3 is a schematic perspective view of essential parts of blank sorting apparatus by means of which the present method may satisfactorily be carried out.

A method for sorting paperboard blanks according to the present invention will be described hereinafter with reference to the accompanying drawings. The overall construction of the apparatus for performing the inventive method has already been described with respect to FIG. 1, and further description thereof will therefore be omitted; only FIG. 3 shows the details of the mechanism of the first and second conveyors 22,24. As shown therein, the first and second conveyors 22,24 are disposed downstream of a sandwich conveyor 18, with a slight incline relative to the blank feed level. The first and second conveyors 22,24 are designed to be driven at a slow regular speed Vc, which is, for example, one third to one quarter of the production line speed Vdf max, so that one blank may overlap another, and are adapted to be driven synchronously at an increased speed by means of an order change command which will be explained later.

The first and second conveyors 22,24 are driven either in common or selectively through means of a common drive source 26 and a clutch/brake 28. The first conveyor 22 includes a plurality of transversely spaced belts 30 trained around a pair of transversely extending pulleys 32; and a vacuum box 34 disposed between the upper and lower reaches of the belts 30. The vacuum box 34 has formed within its upper surface a plurality of suction ports 36 which are located between the adjacent belts 30. A vacuum pump 38 is provided and communicates with the vacuum box 34 through means of a duct 40. Thus, by activating the vacuum pump 38, a vacuum suction area may be formed within the region where the suction ports 36 are located, which vacuum suction area is effective to apply a suction force to the blanks 14 fed onto the belts 30.

The second conveyor 24 includes a single wide belt as shown in FIG. 3 and is adapted to be driven by means of the common drive source 26 which drives the first conveyor 22. The first conveyor 22 may be stopped independently of the second conveyor 24 by means of the clutch/brake 28 attached to the drive source 26.

Extending over the first and second conveyors 22,24 and designated by the reference numeral 42 is means for exerting a desired downward pressure and braking force to the blanks 14 fed onto the conveyors 22,24. Such means may preferably be brushes with bristles fabricated from a tough molded plastic material and yet densely arranged. Furthermore, reference numeral 44 designates a conveyor drive system for driving the sandwich conveyor 18 which comprises a motor, belts and other components. It is to be noted that the sandwich conveyor 16 and the cutters 10 shown in FIG. 1 are not shown in FIG. 3.

The inventive method for sorting paperboard blanks which uses the apparatus thus constructed will now be described.

FIRST EMBODIMENT

Figure 1:
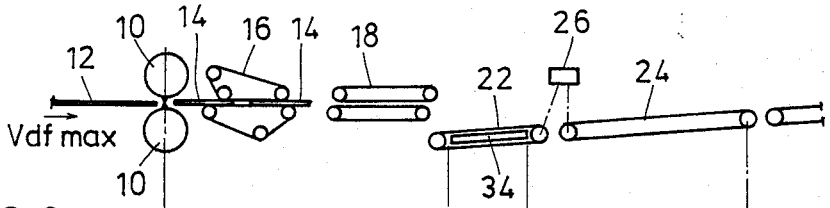
FIG. 1 is a schematic view illustrating the overall arrangement of paperboard sorting apparatus which is capable of performing the paperboard blank sorting method of the present invention.
Figure 2:
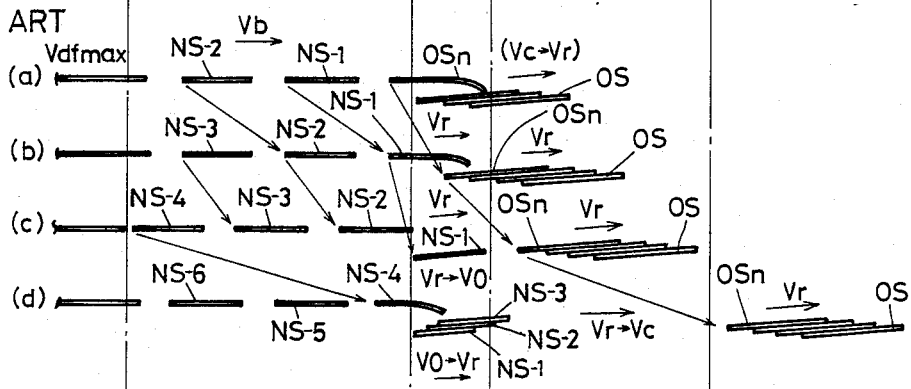
FIG.2 PRIOR ART
FIGS. 2(*a*)–2(*d*) are schematic representations illustrating the isolation of old and new blanks in various phases of operation in accordance with the prior art method.

With reference to FIG. 1, the long paperboard web 12 continuously fed from the upstream corrugation board production line driven at the speed Vdf max is cut by means of the cutters 10 into individual blanks 14 of a predetermined length. The blanks 14 are then supplied to the sandwich conveyors 16,18, fed at a speed Vb which is higher than the line speed Vdf max, and ultimately discharged to the first conveyor 22. It is to be noted that the first and second conveyors 22,24 are normally driven at a regular speed Vc which is lower than the line speed Vdf max (Vb>Vdf max>Vc).

Figure 4:
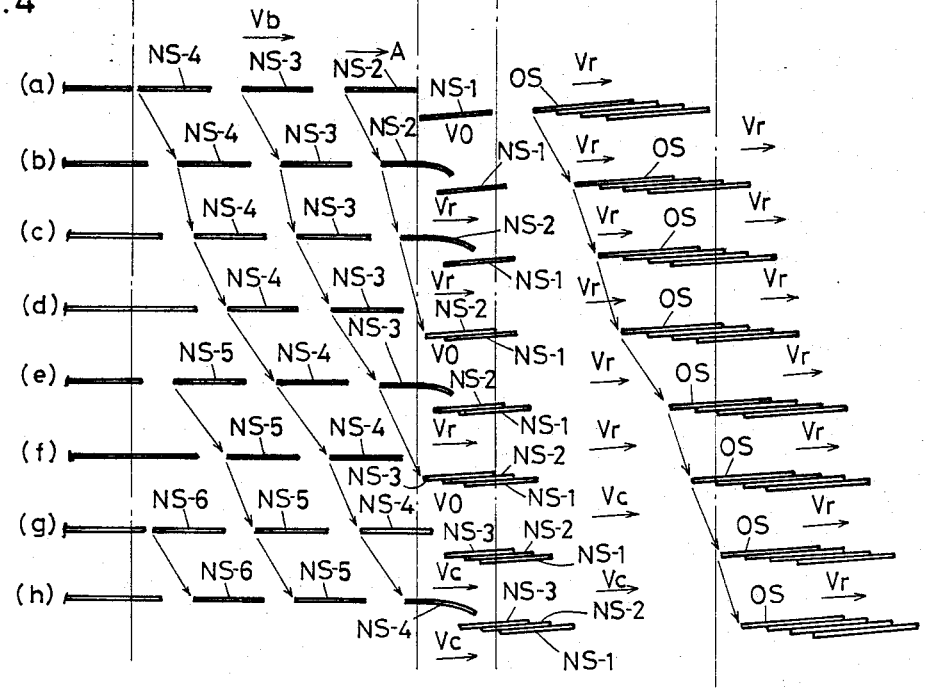
FIGS. 4(*a*)–(*h*) are schematic representations illustrating how the second and subsequent blanks are discharged to the first conveyor and are set upon the previous blanks in accordance with the teachings of the present invention.

According to the present invention, every time the blanks NS-1, NS-2, NS-3 . . . formed in accordance with a new order and having a different length arrive at the first conveyor 22 which is in its stopped condition and overlap one another, the brake of the clutch/brake 28 is released and the clutch thereof actuated, so as to thereby intermittently drive the first conveyor 22 at the increased speed of the second conveyor 24. FIGS. 4(*a*)–4(*h*) show various phases of the operation of the apparatus in accordance with the blank sorting method of the present invention.

During normal operation prior to an order change, the first and second conveyors 22,24 are driven at the regular speed Vc. Upon receipt of an order change command, the sorting method described in applicant's aforenoted Japanese Laid-Open Patent Publication No. 60-258055 is carried out. The first and second conveyors 22,24 are then operated at an increased speed Vr so that the blanks formed in accordance with the old order may be effectively isolated from the blanks formed in accordance with the new order; the last sheet OSn of the blanks OS formed in accordance with the old order is transferred to the second conveyor 24. As soon as this isolation is effected between the blanks formed in accordance with the old and new orders, the brake of the clutch/brake 28 is activated and the clutch thereof released so as to thereby instantly stop the first conveyor 22 (Vr−Vo). The second conveyor 24 continues to be operated at the increased speed Vr.

Thereafter, as shown in FIG. 4(*a*), the blanks formed in accordance with the new order and cut by means of the cutters 10 are fed in the direction of the arrow A onto the sandwich conveyors 16,18 which are being operated at the speed Vb, and the first blank NS-1 is discharged onto the first conveyor 22. At this time, the first conveyor 22 is in its stopped condition (Vo), and the suction force is acting within the vacuum suction area, so that the first discharged blank NS-1 may be positively held in place upon the conveyor 22 even though the blank has an inertial force created as a result of the speed Vb.

Next, as shown in FIG. 4(*b*), when the second blank NS-2arrives at the first conveyor 22 which is in its stopped condition, a suitable sensing means detects the arrival of the second blank NS-2, releasing the brake of the clutch/brake 28 and connecting the clutch thereof. Thus, the speed of the first 22 coincides with that of the second conveyor 22 driven at the speed Vr(Vo→Vr). The first conveyor 22 is driven for a predetermined short period of time at the speed Vr, and is stopped (Vr→Vo) as shown in FIG. 4(*d*), after the second blank NS-2 has been transferred to the first conveyor 22. Furthermore, because the first conveyor 22 has also been driven, the previously arrived blank NS-1 is transferred a predetermined distance as shown in FIG. 4(*c*).

In this manner, the second blank NS-2 discharged onto the first conveyor 22 has an inertial force resulting from the high speed Vb imparted thereto by means of the sandwich conveyor 18. However, during the discharge process, the speed of the first conveyor 22 is increased to the speed Vr and hence, the reduction ratio or speed differential of the second blank NS-2 becomes relatively small (Vb−Vr) and the second blank NS-2 gently lands upon the preceding first blank NS-1 in a manner such that a moderate braking force is applied to the second blank NS-2. In addition, the predetermined amount of movement of the first arrived blank NS-1 causes the vacuum suction area of the first conveyor 22 to be exposed to the extent that the blank NS-1 has moved, so that the suction force may be applied to the second blank NS-2. Thereupon, the second blank NS-2 is sucked onto the first conveyor 22 and as shown in FIG. 4(*d*), it is brought into the shingling position in which a part of the second blank NS-2 overlaps the rear end portion of the first blank NS-1.

Various systems have been suggested to determine the timing at which the new blank arrives at the first conveyor 22. For instance, pulse generators may be mounted upon the rotary shafts of the sandwich conveyors 16,18 as a predetermined reference position with respect to the cutters 10. The pulse generators generate a pulse signal for each detected blank, which signal is fed to a counter. In addition, a photoelectric sensing means for detecting the end of each blank may be provided adjacent the rotary shaft disposed at the downstream end of the sandwich conveyor 18. The sensing means generates a signal for each detected blank end which is operable to increase the speed of the first conveyor 22. Either system may satisfactorily accomplish the intended purpose.

Also, various systems have been suggested for moving the previously arrived blank NS a predetermined distance. For instance, these systems include a variable-setting delay timer provided within the associated electric control circuit; and a pulse generator mounted upon the drive shaft of the first conveyor 22 for sensing movement of the blank NS, or a proximity body and a proximity sensor. The pulse generator or sensor generates a signal for each detected movement of the blank NS, which signal is fed to a counter and is counted up thereby. Again either system may satisfactorily accomplish the intended purpose.

Figure 5:
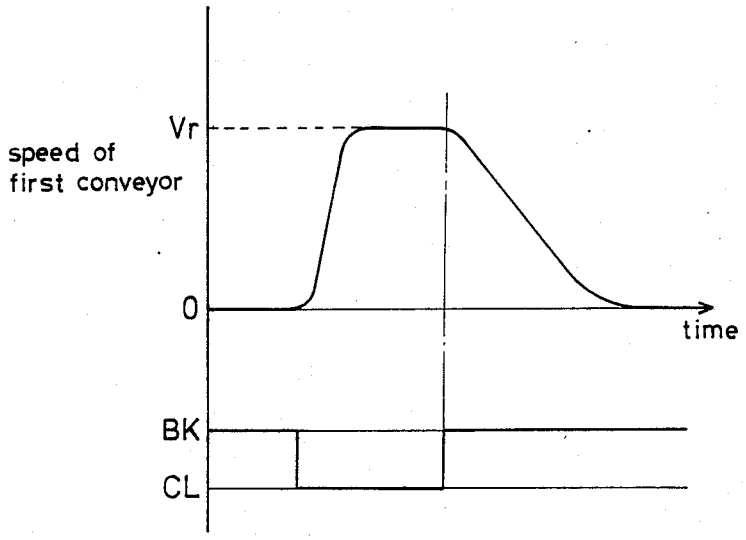
FIG. 5 is a graph illustrating the relationship between the activation of the clutch/brake and the speed of the first conveyor.

It is to be noted that the speed of the first conveyor 22 in response to the activation of the clutch/brake 28 is electrically controlled in a switching manner. Since the conveyor 22 generates inherent sliding or slipping characteristics, a characteristic curve as shown in FIG. 5 may be obtained, which improves the cushion braking action previously described.

Referring to FIG. 4(*e*) in particular, a third blank NS-3 is sensed by the aforementioned suitable sensing means immediately before it arrives at the first conveyor 22 which is in its rest condition, so as to thereby release the brake of the clutch/brake 28 and engage the clutch thereof. The first conveyor 22 is then accelerated to the speed Vr of the second conveyor 24(Vo→Vr), thereby moving the preceding second blank NS-2 a predetermined distance as shown in FIG. 4(*f*), and subsequently the conveyor 22 is stopped (Vr→Vo). In this way, the first conveyor 22 is intermittently driven and stopped so that the succeeding blanks may be subjected to the vacuum suction force within the first conveyor 22 and thereby stopped at a regular position on the conveyor 22. Thus, a proper shingling condition may be obtained in which each of the succeeding blanks partially overlies each of the preceding blanks.

In the embodiment illustrated, at the stage of FIG. 4(*f*), the last sheet OSn of the blanks OS formed in accordance with the old order is just about to leave the second conveyor 24 which is operated at the speed Vr, and at the stage of FIG. 4(*g*), the last sheet OSn has completely left the second conveyor 24. This condition is sensed by a suitable means so as to return the second conveyor 24 from the increased speed Vr to the regular speed Vc(Vr→Vc). Similarly, in FIG. 4(*g*), the first conveyor 22 is at a position in which a fourth blank NS-4 for the new order is just about to arrive there. At this time, the brake of the clutch/brake 28 is released and the clutch thereof is connected. Thereupon, the first conveyor 22 is accelerated to the speed Vc(Vo→Vc) which is the regular speed Vc of the second conveyor 24, so as to move the previously arrived third blank NS-3 a predetermined distance as shown in FIG. 4(*h*), and the first conveyor 22 is ultimately stopped (Vc→Vo). In this way, the first conveyor 22 is intermittently driven and stopped so that the succeeding blanks may be subjected to the vacuum suction force from the first conveyor 22 and stopped at a predetermined position upon the conveyor 22. Thus, a proper shingling condition may be obtained in which each of the succeeding blanks partially overlies each of the preceding blanks.

SECOND EMBODIMENT

Figure 6:
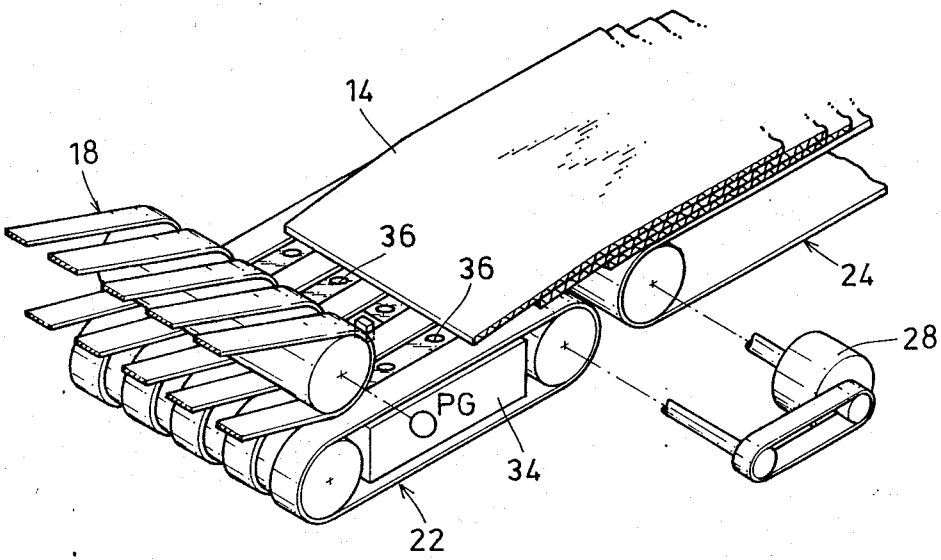
FIG. 6 is a schematic perspective view of the essential parts of apparatus for performing another method of an the present invention.
Figure 7:
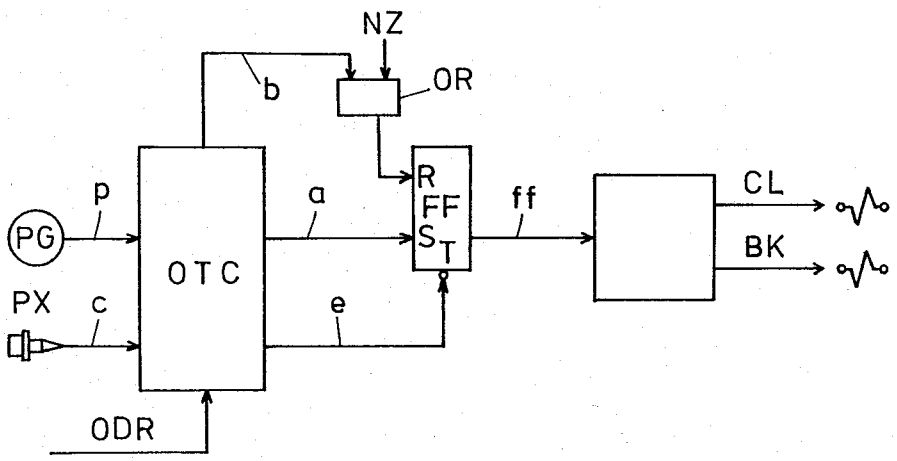
FIG. 7 is a block diagram of an electrical circuit for controlling the apparatus shown in FIG. 6.
Figure 8:
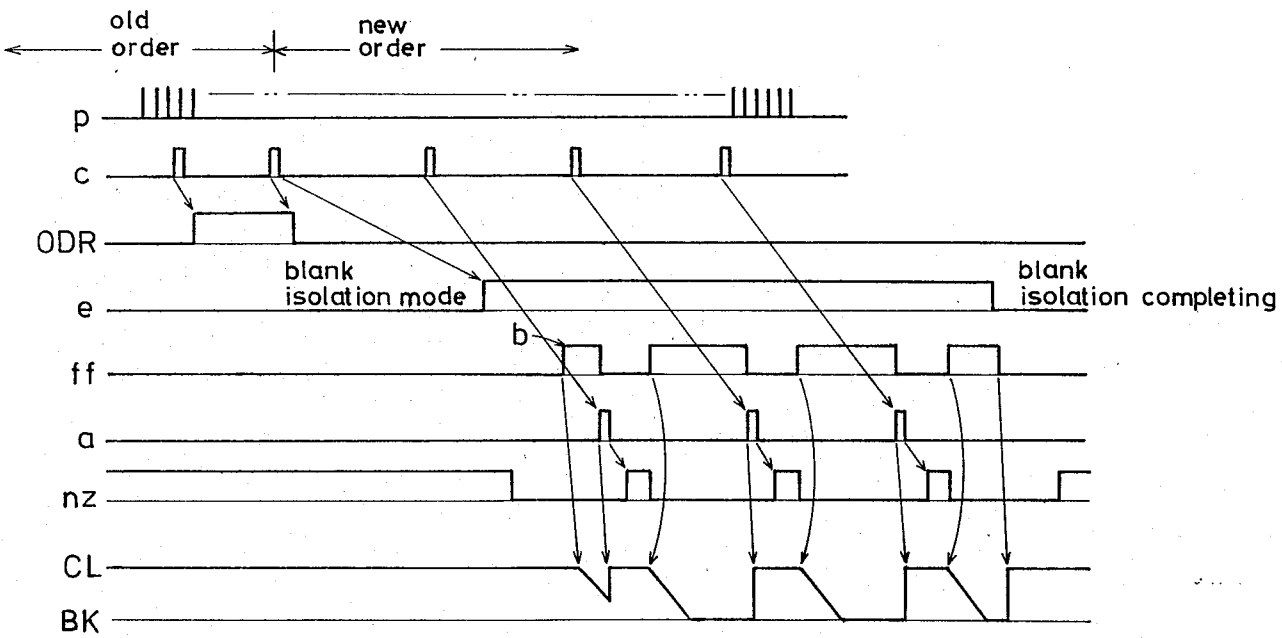
FIG. 8 is a timing chart which may be obtained in accordance with the electrical circuit shown in FIG. 7.

FIGS. 6 to 8 show another sorting method according to a second embodiment of the present invention. Broadly, the alternate method is concerned with the first conveyor 22 having a vacuum suction area. When blanks formed in accordance with a new order successively arrive at the first conveyor 22, the conveyor 22 is controlled so that the vacuum suction area may be positively exposed behind the preceding blanks. Specifically, as shown in FIG. 7, a capacitance-operated proximity switch NZ is provided within the vicinity of the vacuum suction area of the first conveyor 22 and is adapted to generate a blank-presence signal nz every time a blank arrives at the first conveyor 22 (or generate a blank-absence signal nz when the blank has not arrived at the first conveyor 22). In addition, a pulse generator PG is provided upon one rotary shaft of the sandwich conveyor 18 and is adapted to generate a pulse signal P for measuring the blank flow rate.

In the block circuit shown in FIG. 7, a pulse signal P from the pulse generator PG, a web cut signal c from a proximity switch PX mounted upon the rotary cutter 10, and an order change signal ODR produced from a cutter control panel (not shown) are input into a timing control section OTC which is operable during an order change, and these signals are calculated within the timing control section OTC. A timing signal b representing the transfer of the last blank OSn formed in accordance with the old order to the second conveyor 24 is input into an OR circuit OR. Another timing signal "a" representing the arrival of each of the blanks NS formed in accordance with the new order at the first conveyor 22 is input into the terminal S of a flip flop FF.

The blank-absence signal nz from the proximity switch NZ is input into the OR circuit OR, and the output signal from the OR circuit OR is input into the terminal R of the flip flop FF. In addition, the timing control section OTC produces a signal e which signifies that the blank isolation mode is performed during the order change, which signal e is input into the terminal T of the flip flop FF. Thereafter, as shown in FIG. 8, when a signal e representing the blank isolation mode is input into the flip flop FF, and when a blank-absence signal nz (which indicates that no blank is disposed upon the first conveyor 22) is output from the proximity switch NZ, and every time a timing signal "a" representing the arrival of the blank NS formed in accordance with a new order is input into the flip flop FF, a signal ff to connect the clutch CL and release the brake BK is output from the flip flop FF to the clutch/brake 28.

During the order change, however, when the last blank OSn formed in accordance with the old order is transferred to the second conveyor 24, a signal b representing the transfer timing is input to the OR circuit OR and further to the flip flop FF. As a result, a signal ff to disengage the clutch CL and actuate the brake BK is output to the clutch/brake 28, thereby stopping the first conveyor 22 in a manner as mentioned above.

Next, when a timing signal "a" representing the arrival of a blank NS formed in accordance with the new order is input into the flip flop FF, a signal ff is output, as mentioned above, to connect the clutch CL and release the brake BK of the clutch/brake 28, thereby driving the first conveyor 22. The proximity switch NZ then detects the presence of the blank, and after a predetermined time delay, the clutch CL is disengaged and the brake is actuated, thereby stopping the first conveyor 22. Thus, intermittent driving and stopping operations are repeated for the first conveyor 22 until a blank isolation complete signal e is input into the flip flop FF.

In this way, the first conveyor 22 having a vacuum suction area is intermittently driven for a predetermined time, in response to each time at which the blank formed in accordance with the new order arrives at the conveyor. The previously arrived blank is then moved upon the first conveyor 22 so as to expose the vacuum suction area rearwardly thereof. Thus, the succeeding blanks, being drawn onto the vacuum suction area, may be positively accumulated upon the conveyor 22 in a shingling condition.

It should be appreciated that although the first and second embodiments have been described in terms of the clutch/brake 28 for intermittently driving the first conveyor 22, a servomotor could be used for the same purpose which may be provided independently of the drive source for the second conveyor 24.

While the invention has been described with reference to preferred embodiments thereof, it is to be understood that modifications or variations may be easily made without departing from the spirit of this invention which is defined by the appended claims.

What is claimed is:

1. A method for sorting paperboard blanks of a first length specified by a first order from paperboard blanks of a second length specified by a second order wherein a continuous paperboard web is cut into individual blanks of an identical length as specified by means of a particular order, and wherein the output blanks are fed by first and second conveyors in partially overlapped shingled condition, said method comprising the steps of:

sensing arrival of the last sheet of said blanks, as specified for said first order, at said first conveyor;

simultaneously accelerating said first and second conveyors;

sensing the transfer of all of said blanks, as specified for said first order, to said second conveyor;

momentarily stopping said first conveyor;

feeding a first sheet of said second order onto said first conveyor while said second conveyor is maintained in its stopped condition;

sensing the arrival of a second sheet of said blanks specified for said second order to said first conveyor which is maintained in its stopped condition; and driving said first conveyor for a predetermined amount of time so as to move said first sheet of said second order, disposed upon said first conveyor, relative to said second sheet of said second order being conveyed onto said first conveyor whereby said first and second sheets of said second order will attain a shingled condition upon said first conveyor.

2. A method as defined in claim 1, further comprising the steps of:

subsequent to said driving step, moving downstream the blanks specified for the second order and arrived previously on said first conveyor;

accumulating the blank groups for the second order on said first conveyor in partially overlapped condition; and returning said first and second conveyors to their regular speed.

3. A method for sorting paperboard blanks of a first length as specified by means of a first order from paperboard blanks of a second length as specified by means of a second order wherein a continuous paperboard web is cut into individual blanks of an identical length as specified by means of a particular order, and wherein the output blanks are fed in partially overlapped shingled condition by means of a first conveyor having a vacuum suction area, and by means of a second conveyor, said method comprising the steps of:

sensing the arrival of the last sheet of said blanks, as specified for said first order, to said first conveyor;

simultaneously accelerating said first and second conveyors;

sensing the transfer of all of said blanks, as specified for said first order to said second conveyor;

momentarily stopping said first conveyor;

feeding a first sheet of said second order onto said first conveyor while said first conveyor is maintained in its stopped condition;

sensing the arrival of a second sheet of said blanks as specified for said second order to said first conveyor which is maintained in its stopped condition; and driving said first conveyor for a predetermined amount of time so as to thereby move said first sheet as specified for said second order a predetermined distance downstream upon said first conveyor so that said vacuum suction area, defined upon said first conveyor, may be exposed to said second sheet of said second order being conveyed onto said first conveyor so as to retain said second sheet of said second order upon said first conveyor whereby said first and second sheets of said second order will be disposed in a shingled condition upon said first conveyor.

* * * * *